United States Patent [19]

Montean

[11] Patent Number: 4,967,185

[45] Date of Patent: Oct. 30, 1990

[54] MULTI-DIRECTIONALLY RESPONSIVE, DUAL-STATUS, MAGNETIC ARTICLE SURVEILLANCE MARKER HAVING CONTINUOUS KEEPER

[75] Inventor: Samuel Montean, Blaine, Minn.

[73] Assignee: Minnesota Mining and Manufacturing Company, St. Paul, Minn.

[21] Appl. No.: 391,089

[22] Filed: Aug. 8, 1989

[51] Int. Cl.[5] ..... G08B 13/14

[52] U.S. Cl. ..... 340/572; 340/551

[58] Field of Search ..... 340/572, 551

[56] References Cited

U.S. PATENT DOCUMENTS

| | | | |
|---|---|---|---|
| 3,665,449 | 5/1972 | Elder et al. | 340/280 |
| 3,747,086 | 7/1973 | Peterson | 340/280 |
| 4,120,704 | 10/1978 | Anderson | 148/103 |
| 4,309,697 | 1/1982 | Weaver | 340/551 |
| 4,689,590 | 8/1987 | Heltemes | 340/572 |
| 4,710,754 | 12/1987 | Montean | 340/572 |
| 4,746,908 | 5/1988 | Montean | 340/551 |
| 4,825,197 | 4/1989 | Church et al. | 340/572 |

FOREIGN PATENT DOCUMENTS

| | | | |
|---|---|---|---|
| 763681 | 11/1933 | France | 340/572 |

*Primary Examiner*—Joseph A. Orsino
*Assistant Examiner*—Geoff Sutcliffe
*Attorney, Agent, or Firm*—Donald M. Sell; Walter N. Kirn; William B. Barte

[57] ABSTRACT

A multi-directionally responsive, dual-status marker for use in electronic article surveillance systems having an alternating magnetic field within an interrogation zone. The marker comprises a piece of a high permeability, low coercive force magnetic material substantially co-extensive with a piece of remanently magnetizable material, in which the first piece is configured to exhibit at least two elongated responsive areas adjacent to edges of the piece perpendicular to each other, each area having a narrow width region forming a switching section and adjacent extensive regions forming flux collectors. In a preferred embodiment, the inner edges of all of the regions are defined by a narrow band of removed material, the remaining material in the center thereby being magnetically isolated from the responsive areas. The marker is desensitized by uniformly magnetizing the pace of unmagnetizable material.

13 Claims, 2 Drawing Sheets

MULTI-DIRECTIONALLY RESPONSIVE, DUAL-STATUS, MAGNETIC ARTICLE SURVEILLANCE MARKER HAVING CONTINUOUS KEEPER

FIELD OF THE INVENTION

This invention relates to electronic article surveillance (EAS) systems of the general type in which an alternating magnetic field is produced in an interrogation zone and in which a magnetically responsive marker present in the zone results in the production of a characteristic signal which is detected and processed to create a suitable response, alarm, etc.

BACKGROUND OF THE INVENTION

Modern magnetically based electronic article surveillance systems generally derive their parentage from 1934 French Pat. No. 763,681. That patent depicts the use of markers formed of a piece of low coercive force, high permeability alloy, such as permalloy, and teaches that when the magnetization of such a piece is reversed by a magnetic field alternating at a fundamental frequency, detectable harmonics of that frequency will be produced.

More recently, various investigators have developed magnetic markers which have dual-status capabilities. Typically, as first disclosed in U.S. Pat. Nos. 3,665,449 (Elder et al.) and 3,747,086 (Peterson), such dual-status markers include at least one piece of low coercive force, high permeability material together with at least one piece of remanently magnetizable material. When the latter piece is magnetized it has associated therewith a magnetic field which biases the low coercive force, high permeability material so as to alter the signal produced when the biased material is in the interrogation field. It is also disclosed in the '449 patent that such dual-status markers may comprise coextensive strips of magnetizable material and high permeability, low coercive force material, and while not preferred, that the magnetizable material could be uniformly magnetized. That patent fails to suggest how signals from such markers in which the magnetizable strip is alternatively not magnetized or is uniformly magnetized could be reliably distinguished Similarly, one marker embodiment depicted in the '086 patent comprises two coextensive strips. While that patent indicates that magnetization of one strip alters the harmonic content of the signal produced by the other, the exact nature of the magnetization is not specified. The disclosure pertaining to FIG. 6D of the '086 patent suggests only that magnetization be such as to leave the responder strip in a fully magnetized condition, thereby causing the marker to be completely silent While the '449 and '086 patents thus suggest that single directionally responsive markers may be deactivated by a magnetic bias field extending the full length of the responder strip, it has now become well recognized that reliable deactivation is obtained by providing discontinuous fields so that the responder strip essentially responds as a number of strips of shorter length. This is effected in typical, commercially viable systems by providing a number of magnetizable pieces spaced along the responder strip or by providing a continuous strip of magnetizable material which is magnetized in bands of alternating polarity.

More recently, multi-directionally responsive magnetic markers have also been developed. Thus, for example, as set forth in a recent patent of the present inventor, i.e., U.S. Pat. No. 4,710,754 such markers may comprise a square piece of low coercive force, high permeability material fabricated to have regions with narrow widths centered along each edge of the squares, thereby providing switching sections and extensive regions in each corner which collect and channel flux into the switching sections. The markers of the '754 patent are made dual-status by adding discrete pieces of magnetizable material adjacent each switching section.

A further embodiment of a dual-status, multi-dimensionally responsive marker is disclosed in U.S. Pat. No. 4,825,194 (Church et al.) in which discrete magnetizable pieces are positioned adjacent flux collector sections of a sheet of responder material Optionally, that patent also suggests that additional pieces of magnetizable material may be positioned adjacent the switching sections, but that the separation between the respective magnetizable pieces be sufficient to prevent appreciable magnetic coupling therebetween.

Multi-dimensionally responsive markers in which a coextensive sheet of magnetizable material is provided together with a sheet of low coercive force, high permeability responder material are disclosed in a second, recent patent of the present inventor, i.e., U.S. Pat. No. 4,746,908. However, the markers of the '908 patent function in a significantly different manner and utilize a piece of responder material configured so as not to create a desired response The coextensive sheet of magnetizable material is magnetized with a predetermined pattern which biases only adjacent portions of the responder material, thereby inhibiting response from those portions. The magnetized pattern is such that the dimensions of the unbiased, remaining portion can then produce the desired response. Such markers thus function oppositely to those in typical use, i.e., that the marker is magnetized when in its sensitive state.

SUMMARY OF THE INVENTION

The marker of the present invention departs from the traditional wisdom followed in the present, commercial magnetic EAS systems described above in which markers are deactivated by magnetizing to provide a plurality of discrete fields which bias selected portions of the marker. Rather, it has now been found that multi-dimensionally responsive markers somewhat similar to those preferred in the '754 patent may be reliably changed from a first, active state, to a second, deactive state, by applying a magnetic field to uniformly magnetize a coextensive magnetizable sheet in any direction in the plane of the sheet. The marker may be subsequently changed, or switched back to the active state by demagnetizing the magnetizable sheet. Such a marker thus comprises two coextensive magnetic sheets in which the width of the sheets is not less than one-half the length. The first sheet is selected of a material having a high permeability and low coercive force, and is configured to have at least two, mutually perpendicular elongated areas proximate to the periphery of the sheet. Each of the elongated areas is capable of responding to an alternating magnetic field in an interrogation zone generally applied along the length of the area to result in the production of an alarm. Each area thus includes a narrow width region forming a switching section and extends on each end along the length into extensive regions forming flux collector sections for the adjacent switching section.

The second sheet is selected of a remanently magnetizable material, which overlies and is magnetically coupled to the sheet of responder material. This magnetizable sheet, when substantially uniformly magnetized in the plane of the sheet, causes alternate polarity switching pulses resulting from a reversal of magnetization of the switching sections when exposed to alternating fields, to be shifted in time and/or altered in amplitude. Markers having the magnetizable sheet alternatively magnetized or demagnetized can then be distinguished from each other.

In a particularly preferred embodiment, the marker of the present invention comprises a substantially square responder sheet having switching sections centered along the edge of each side and flux collector sections in each of the corners of the sheet. Also, in a preferred embodiment, each of the elongated areas in the sheet of responder material is configured to have inner edges of both the narrow width region and extensive regions defined by a continuous narrow band in which the material is absent, the remaining innermost portion of the sheet thus being substantially magnetically isolated from the rest of the sheet, but physically present so as to provide a substantially uniformly thick, homogeneous appearance to a complete marker.

As noted above, the two states of the marker of the present invention are manifested by differences in the time at which alternate polarity pulses are produced and by differences in the amplitude of the respective pulses, depending upon whether or not the magnetizable sheet is magnetized. The present invention thus also includes an EA$ system for use with such markers. In addition to the markers themselves, the system thus comprises means, such as a drive oscillator, amplifier, and field coils, for generating within an interrogation zone an alternating magnetic field, means for receiving marker produced signals and ultimately producing an alarm signal when appropriate and means for magnetizing the magnetizable material in the markers. The magnetizing means preferably provides a single, substantially uniform magnetic dipole in the magnetizable sheet, one edge of the sheet having one magnetic polarity and an opposite edge having the opposite polarity.

The receiving means receives signals resulting from flux changes in the marker produced when the marker is exposed to the alternating field in the zone. Means are also included for distinguishing between signals from the markers when the piece of magnetizable material is either magnetized to have a said single magnetic dipole or is demagnetized, and from other signals as may be caused by ambient effects, random ferromagnetic objects and the like. The distinguishing means further comprises means responsive to differences in the amplitude of marker produced signals and to relative displacements of alternate signal components for producing an alarm signal when appropriate.

DETAILED DESCRIPTION

Figure 1A:
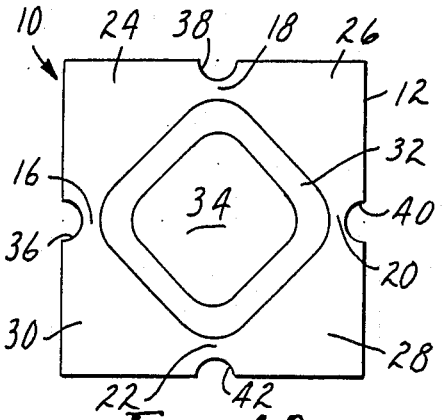
FIGS. 1A and 1B are top views of the two magnetic sheets comprising markers of one embodiment of the present invention.
Figure 1B:
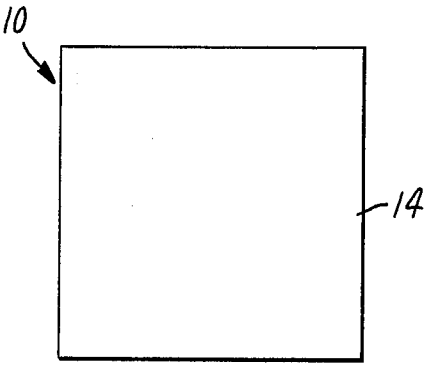

One embodiment of a marker of the present invention is set forth in an exploded view shown in FIGS. 1A and 1B. As may there be seen, such a marker 10 comprises two sheets 12 and 14 of magnetic material. The first sheet 12 is formed of a ferromagnetic material having high permeability and low coercive force properties, such as permalloy, supermalloy or the like. This sheet may also be any of a number of amorphous ferromagnetic compositions, such as an iron nickel composition, Type 2628MB2 or a high cobalt containing composition, Type 2705M, both of which are manufactured by the Allied-Signal Corporation. Such a sheet is preferably configured in a square having four areas 16, 18, 20, and 22 of restricted cross-section, each located at approximately the center of each of the respective sides. These areas thus form switching sections in which magnetic flux will be concentrated by the extensive areas 24, 26, 28 and 30 in each of the corners of the square.

Such a sheet may preferably be further formed to have notches 36, 38, 40 and 42 centered along each edge to further define the widths of the switching areas 16, 18, 20 and 22.

In an alternative embodiment, the marker may be formed of such a sheet of high permeability, low coercive force material in which the inner edges of the respective areas of restricted cross-section and the extensive corner areas are defined by a generally square narrow band 32 in which the magnetic material has been removed, thus leaving an innermost region 34 in which the material is still present as is further shown in FIG. 1A. The narrow band of removed material 32 thus isolates the center portion 34 from the magnetically active switching sections and flux collector sections respectively.

The second sheet 14 of the marker 10 is coextensive with the first sheet 12 and comprises a solid sheet of a magnetizable material such as vicalloy, magnetic stainless steel, Chromendur II or the like. A preferred construction utilizes Arnokrome TM, an iron, cobalt, chromium and vanadnium alloy marketed by Arnold Engineering Co., Marengo, Ill., such as the Alloy "A" described in U.S. Pat. No. 4,120,704, which is assigned to that company. In a particularly desired configuration, a sheet of such material may be heat treated to provide a coercive force of approximately 80 oersteds. Other alloys having coercive forces in the range of 40 to 200 oersteds are likewise acceptable. To ensure the same response to both desensitizing (magnetizing) fields and to interrogating fields, regardless of the orientation of the marker with respect to those fileds, it is also desirable that the sheets be isotropic, particularly so as to exhibit the same magnetic properties in all directions in the plane of the sheet.

The two sheets 12 and 14 are then preferably joined together via a pressure-sensitive adhesive or the like and the combined layers in turn sandwiched between an underlying layer of pressure-sensitive adhesive and release liner in order to allow the markers to be dispensed and affixed to articles to be protected and a top layer enabling customer indicia, price information etc. to be provided on the marker.

In a preferred embodiment as shown in FIGS. 1A and 1B, the first sheet 12 was preferably made of a one inch square section of permalloy, 0.0006 inches thick. The sheet was further formed with the removed section 32 in which the width of the removed band was approximately 0.094 inch, the width of the switching sections 16, 18, 20 and 22 was 0.030 inch and the diameter of the semi-circular notches adjacent each of the switching sections was 0.125 inch. The second sheet 14 was a one inch square section of Arnokrome TM alloy 0.0008 inches thick, treated to have a Hc about 80 Oe, as described above.

It has now been found that such a marker may be reliably switched from a first, active state into a second, deactivated state, by substantially uniformly magnetizing the magnetizable sheet in the plane of the sheet so as to exhibit a first magnetic polarity along one edge of the sheet and an opposite polarity at the opposite edge of the sheet. By thus magnetizing the magnetizable sheet of keeper material, it has generally been found that the respective switching elements will be biased so that alternate polarity switching pulses from the respective elements will occur at a different time than that from an unbiased marker and the respective switching pulses will be significantly altered in amplitude.

An unbiased switching element will saturate or switch in an alternating magnetic field when the field reaches a given intensity, depending upon the coercivity of the switching element. Accordingly, if the time between a negative and positive pulse is substantially the same as the time between a positive and negative pulse when the marker is interrogated by a sinusoidal alternating field, the marker will be deemed to be sensitized. In contrast, if the keeper sheet is magnetized, the time between the positive pulse and the negative pulse will be different than that between the negative and the positive pulse, and detection logic in a system may be used to differentiate between an unbiased (sensitized) marker and a biased (desensitized) marker. As the amplitudes of harmonics generated by a marker when interrogated by an alternating magnetic field are also substantially altered and for the most part, decreased by the presence of the bias due to the magnetized sheet, detection logic may also be utilized to respond to such differences in amplitude.

It has also been found that when the sheet of keeper material is magnetized by an unidirectional field so as to exhibit a single magnetic dipole extending from one edge to the opposite edge of the sheet, the magnetization in the sheet may be affected by the configuration of the adjacent high permeability, low coercive force sheet. By thus selecting the sheet of magnetizable material to have a relatively low coercive force, i.e., in the range of 60-90 oersteds, the magnetization in the sheet of magnetized keeper material may be imprinted with the configuration of the sheet of responder material. Such a magnetization pattern can, for example, be seen by separating the sheet of responder material from the sheet of keeper material and thereupon viewing the magnetization pattern with a magnetic viewer. The magnetization pattern arises during the magnetization process because some of the flux coming out of the flux collector and switching sections enters the relatively low coercive force sheet of keeper material and thereby alters the magnetization therein. The collector and switching elements thus ultimately become more highly saturated and the state of desensitization of the marker is thereby enhanced.

Figure 2A:
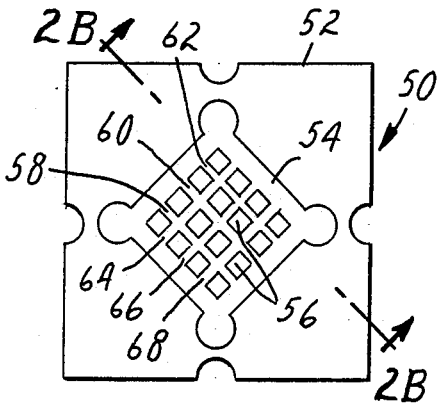
FIGS. 2A and 2B are bottom and cross-sectional views of another embodiments of the present invention.
Figure 2B:
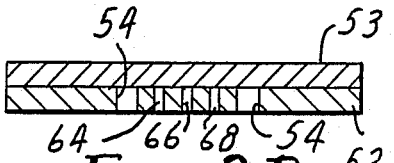

An alternate preferred construction of the marker of the present invention is shown in FIGS. 2A and 2B. As shown in FIG. 2A, the marker 50 is formed of a sheet 52 of high permeability, low coercive force responder material like that described in conjunction with FIG. 1A. In the embodiment of FIG. 2A, an innermost region 56 within a narrow band 54 of removed material is subdivided by additional narrow bands of removed material 58, 60, 62, 64, 6 and 68 respectively. By thus subdividing the centermost material 56, the propensity for flux directed toward the marker to pass through the band of removed material 54 and into the center area is further lessened, such that the flux collecting capabilities of the corner regions is maximized.

Figure 3:
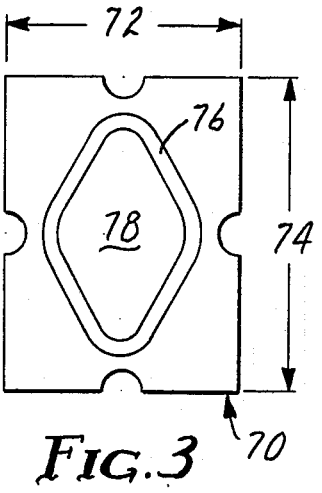
FIGS. 3 and 4 are top views of responder sheets of yet additional embodiments of a marker according to the present invention.

While a square configuration tag such as shown in FIGS. 1A and 1B and 2A and 2B may be preferred, in order to provide equal response regardless of the orientation of the tag, it may further be desired to provide a marker in other than a square configuration. Thus, for example, FIG. 3 sets forth a top view of a further embodiment in which the marker 70 is formed of a piece of high permeability, low coercive force material having a generally rectangular configuration. So long as the width 72 is no less than one-half the length 74 of such a piece, the marker may still be detected under most interrogation field intensities even when the marker is aligned such that the short direction is aligned with the interrogating field. In a preferred mode, the inner edges of the respective switching and flux collector sections are defined by a region 76 of removed material thereby leaving a centermost region 78.

Figure 4:
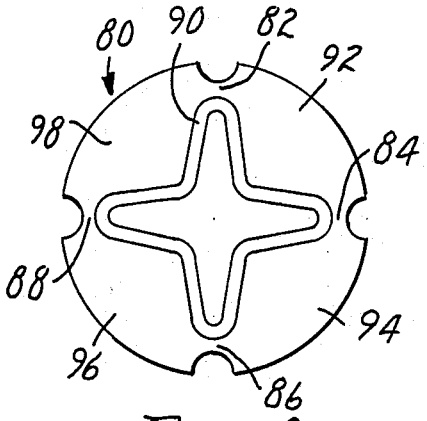

In a yet further alternative construction, the marker may be made of a circular configuration as set forth in FIG. 4. As there shown, the sheet 80 of high permeability, low coercive force material is configured to have regions 82, 84, 86 and 88 of narrow cross-section, the inner edges of which are bounded by a narrow band 90 of removed material. In this embodiment, the narrow band is further configured to enlarge the extensive regions 92, 94, 96 and 98, thereby enhancing the flux collecting capabilities within those regions.

Figure 5:
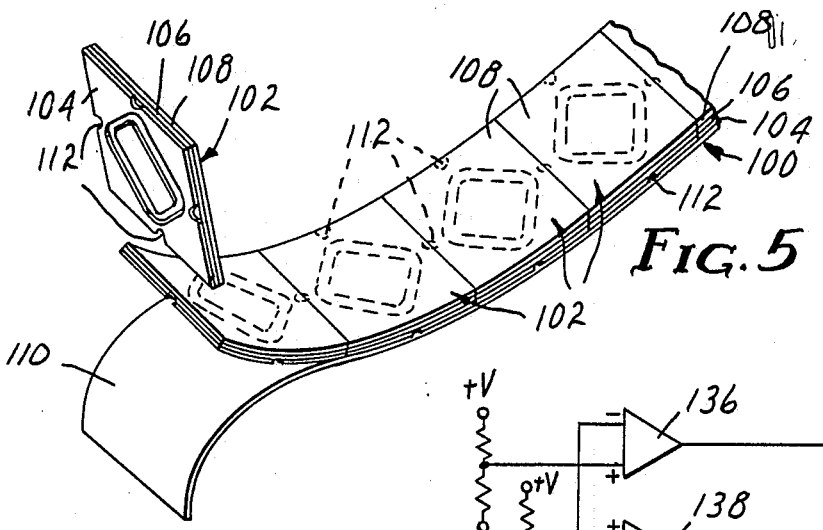
FIG. 5 is a perspective view of a strip of markers as shown in FIGS. 1A and 1B.

A preferred manner in which the markers of the present invention may be manufactured and dispensed is set forth in the perspective view of FIG. 5. It will there be recognized that a plurality of markers extending in orthogonal directions from each other may be formed from large sheets of the respective materials, the sheet of responder material having been first processed to have the configurations as discussed herein. After the respective sheets are laminated together, the respective markers may then be cut into strips as shown in FIG. 5, in a manner suitable for dispensing with conventional label guns and the like. As shown in FIG. 5, such a strip 100 contains a plurality of markers 102. The strips 100 of markers 102 include a layer 104 of high permeability, low coercive force material in which the appropriate configuration has been formed, adhered via a layer of pressure sensitive adhesive (not shown) to a layer of magnetizable keeper material 106. An outermost layer 108 of paper or the like on which customer indicia may be printed may, in turn be adhered to the top of the keeper material 106. An underlying layer of pressure-sensitive adhesive between the bottom most layer 104 and release liner 110 may be provided in order to affix the markers to objects to be protected. Such an adhesive layer is nominally invisible. The benefit provided by the semi-circular holes 112 along the periphery of each of the markers may further be appreciated from FIG. 5, as it will there be noted that as the individual markers are separated from the larger sheets from which they are formed, any variance in the location of the separation lines will affect the respective widths of the switching sections on each side of the line. By providing a hole in the vicinity of the line, which hole is provided at the same time that the band of removed material is formed, the widths of the respective switching sections are thereby precisely determined, and the exact location of the separation line becomes much less important.

The configuration in the sheets of high permeability, low coercive force material may be provided in a number of ways, such as die cutting, etching or the like. When sheets of crystalline materials, such as permalloy or the like are utilized, such materials being notoriously sensitive to mechanical working, it may be desired that the respective regions of removed material be formed via chemical etching techniques in a manner well known to those skilled in the art. Similarly, if sheets of material relatively immune to mechanical workings, such as amorphous alloys, are utilized, conventional die cutting techniques and the like may similarly be employed.

Figure 6:
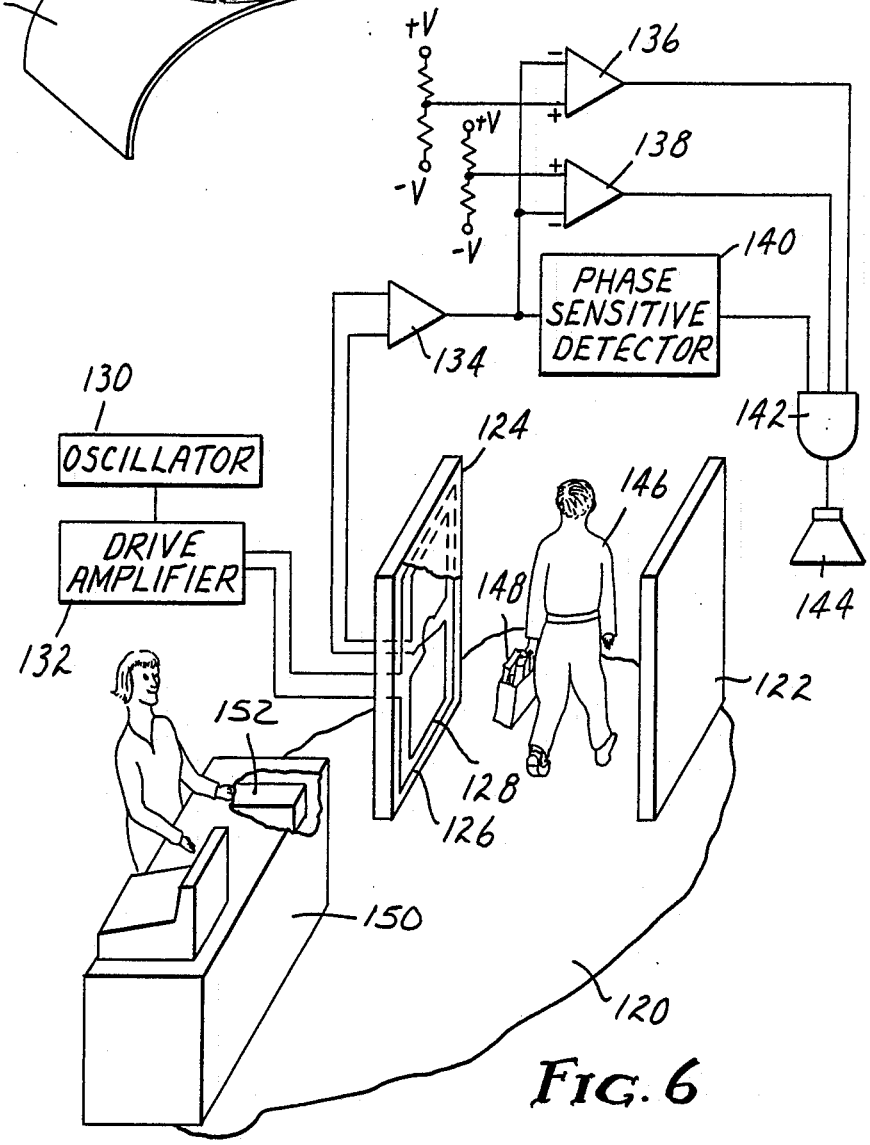
FIG. 6 is a combined pictorial and block diagram of an embodiment of a system according to the present invention.

A system in which the markers of the present invention are preferably utilized is set forth in the combined pictorial and block diagram of FIG. 6. As is typical in magnetic electronic article surveillance systems, the system 120 comprises two spaced apart panels 122 and 124 between which persons carrying objects protected by the markers may be caused to pass. Within the panels are positioned appropriate field coils 126 and detector coils 128, in a manner well known to those skilled in the art. In the present system, the field coil is powered by a suitable oscillator 130 coupled through a drive amplifier 132, producing a magnetic field oscillating at a predetermined frequency, such as approximately 10 kilohertz, within the interrogation zone extending between the panels. The detector coil 128 is in turn coupled through a sense amplifier and filter 134 and thence to a pair of level detectors 136 and 138, respectively, and to a phase sensitive detector 140. The common outputs of the respective detectors are in turn coupled to an alarm logic network 142, which is basically an exclusive AND gate, such that an appropriate signal from all three detectors must be present for the production of a signal to activate an alarm 144. Thus if a patron 146 carrying objects 148 having markers affixed thereto which are in a sensitized condition passes between the pedestals 122 and 124, the presence of the sensitized markers will then be detected and an alarm produced by the alarm unit 144. Conversely, if prior to entering the interrogation zone, the markers are desensitized at a checkout counter 150, at which time the respective markers are placed within a desensitization apparatus 152 within which a substantially continuous magnetization state is impressed upon the magnetizable sheets within each of the markers, thereby rendering the marker desensitized, egress through the interrogation zone may be possible without generating an alarm. Such an apparatus may preferably comprise a permanent magnet having at a top, or working surface, a substantially uniform field of a single polarity. The magnetizable sheets of the markers are then magnetized by passing the marker across the working surface of the apparatus.

The desirability of the detector circuits operating both in response to phases, so as to respond to the respective time between alternate polarity pulses and also to the respective amplitude of the signal pulses, will be further appreciated as it is recognized that as an object is presented for deactivation, the orientation of the marker with respect to the magnetizing fields in the desensitization apparatus 148 will generally be unknown and uncontrolled. Similarly, as an object is carried through the interrogation zone, the orientation of the marker with respect to the interrogating fields will generally be unknown and uncontrolled. Thus it is important that markers be unambiguously recognized as being deactivated regardless of whether the direction of the magnetic dipole impressed on the sheet of magnetizable material is aligned with the interrogating fields, is oriented at 90° with respect to the interrogating fields, or is at any other random angle therebetween.

Taking the two extremes, it will be recognized that if the magnetic dipole is in alignment with an interrogating field, the field associated with the dipole will alternately aid and oppose the interrogating field. In such a case, the time at which the requisite field at which the magnetization in the respective aligned switching elements will reverse will be shifted in time relative to the switching times when no biasing field is present. Such a shift in the spatial position of the signal pulses may then be detected by the phase sensitive detector 140. Conversely, if the field associated with the magnetic dipole is at right angles to the interrogating field, the overall amplitude of the switching pulses will generally be decreased. Such a condition may be recognized by the level detectors 136 and 138, which require signal pulses to exceed a minimum threshold and not to exceed a maximum threshold level in order to create the requisite alarm signal.

In one set of experiments, one inch square markers of 0.0006 inch permalloy configured with a narrow band of removed material and 0.0008 inch Arnokrome TM as set forth in FIGS. 1A and 1B, were evaluated in a system simulating conditions present in a commercial EAS system. When the markers were in a sensitized condition, signals having a general amplitude of about 0.7 (arbitrary units) were observed. The timing between the respective positive and negative pulses was approximately 50 microseconds. When those markers were then deactivated by moving the marker over a permanent magnet having an approximate 150 oersted peak field intensity, the respective signal amplitudes were found to be essentially zero when interrogated in a 5 oersted field. When interrogated in a 10 oersted field, as might be encountered in most intense regions in an antipilferage system interrogation zone, signal intensities of nearly 2.0 (arbitrary units) were observed. Such signals would be detectable and could result in the production of an alarm. However, as the timing between the respective positive and negative pulses dramatically shifted from the 50 microseconds between either positive and negative, or negative and positive pulses by as much as 20 microseconds, logic responsive to the shift prevents such an alarm from being produced.

In a further series of tests where the magnetization field was applied at 45° to the edge of a marker as described above, it was found that while detectable signal values of approximately 0.2 to 0.3 (arbitrary units) were produced when interrogated in a 5 oersted field, the shift between the positive and negative pulses was as much as 20 microseconds.

As noted above, the magnetizable sheets utilized in the markers of the present invention are desirably formed of materials having a coercive force in the range between 40 and 200 oersteds. Thus, for example, in addition to materials such as Arnokrome TM, markers formed of sheets of 301 type stainless steel have also been evaluated and found to be acceptable. Other materials having similar coercive forces may also be used. Materials having coercive forces in the range of 60–90 oersteds are particularly desired both due to the somewhat non-uniform magnetization produced therein due to flux shunting effects of the adjacent, configured piece of responder material and as lower intensity magnetizing fields may be employed, thereby preventing deleterious effects on magnetically sensitive objects such as prerecorded magnetic tapes and credit cards.

I claim:

1. A marker for use in an electronic article surveillance system having in an interrogation zone an alternating magnetic field, comprising a substantially planar sheet of high permeability, low coercive force responder material having a width not less than one half the length, having at least two elongated areas proximate to the periphery of the sheet, the length of at least one elongated area being substantially perpendicular to the length of another elongated area, each said area having a narrow width forming a switching section and extending on each end along the length into extensive regions thereby forming flux collector sections for the adjacent switching section, and a continuous uninterrupted sheet of remanently magnetizable material having substantially the same overall dimensions as said sheet of responder material, overlying and magnetically coupled to said sheet of responder material, which sheet, when substantially uniformly magnetized in the plane of the sheet causes alternate switching pulses resulting from a reversal of magnetization of said switching sections to be shifted in time and/or altered in amplitude, thereby enabling markers having said magnetizable sheet magnetized or demagnetized to be distinguished from each other.

2. A marker according to claim 1, comprising a substantially square responder sheet having switching sections centered along the edge of each side and flux collector sections in each of the corners of the sheet.

3. A marker according to claim 1, wherein said sheet of responder material is configured with a plurality of locations about the periphery at which the material is absent resulting in an irregularity, each irregularity being positioned to define the outer edge of a given switching section.

4. A marker according to claim 1, wherein the sheet of magnetizable material is selected to exhibit a coercive force in the range between 40 and 200 oersteds.

5. A marker according to claim 1, wherein said magnetizable sheet is substantially uniformly magnetized along any given direction in the plane of the sheet so as to exhibit essentially a single magnetic dipole extending from one edge of the sheet to an opposite edge thereof.

6. A marker according to claim 1, wherein said sheets of responder and magnetizable material are substantially square.

7. A marker according to claim 1, wherein said magnetizable material is magnetized to exhibit a said single magnetic dipole extending diagonally from one corner to an opposite corner.

8. A marker according to claim 1, wherein inner edges of both the narrow width regions and the extensive regions are defined by a continuous narrow band in which the material is absent, the remaining innermost portion of the sheet thus being substantially magnetically isolated from the rest of the sheet, but physically present so as to provide a substantially uniformly thick, homogeneous appearance to a complete marker.

9. A marker according to claim 8, wherein said innermost portion of the responder sheet is divided into a plurality of segments.

10. An electromagnetic article surveillance system comprising (a) means for generating within an interrogation zone an alternating magnetic field, (b) a plurality of markers, each comprising a substantially planar sheet of high permeability, low coercive force responder material having a width not less than one half the length, having at least two elongated areas proximate to the periphery of the sheet the length of at least one elongated area being substantially perpendicular to the length of another elongated area, each said area having a narrow width forming a switching section and extending on each end along the length into extensive regions thereby forming a flux collector sections for the adjacent switching section and a continuous uninterrupted sheet piece of remanently magnetizable material substantially the same overall size as the sheet of low coercive force, high permeability material, and extending coextensive therewith, (c) means for magnetizing said remanently magnetizable material to provide therein a single, substantially uniform magnetic dipole, one edge of the sheet of magnetizable material thereby having a one magnetic polarity and an opposite edge having the opposite polarity, (d) means for receiving signals resulting from flux changes in a said marker produced when the marker is exposed to said alternating fields in said zone, and for distinguishing between signals from said markers when said sheet of magnetizable material is either magnetized to have a said single magnetic dipole or is demagnetized, and from other signals as may be caused by ambient effects, random ferromagnetic objects and the like, said distinguishing means further comprising means responsive to differences in amplitude of marker produced signals and relative displacements of alternate signal components as typically occur when said magnetizable sheets are alternatively unmagnetized or magnetized for producing an alarm signal when appropriate.

11. A system according to claim 10, wherein said system further comprises means for demagnetizing a previously magnetized piece of said marker.

12. A system according to claim 10, wherein said magnetizing means includes a permanent magnet assembly having a given magnetic polarity extending at one surface thereof along which surface a said marker may be moved to cause the magnetizable sheet therein to become magnetized.

13. A system according to claim 10, wherein each of said markers comprise a sheet of responder material configured to have inner edges of both the narrow width regions and the extensive regions defined by a continuous narrow band in which the material is absent, the remaining innermost portion of the sheet thus being substantially magnetically isolated from the rest of the sheet, but physically present so as to provide a substantially uniformly thick, homogeneous appearance to a complete marker.

* * * * *

UNITED STATES PATENT AND TRADEMARK OFFICE

CERTIFICATE OF CORRECTION

PATENT NO. : 4,967,185

DATED : October 30, 1990

INVENTOR(S) : SAMUEL MONTEAN

It is certified that error appears in the above-identified patent and that said Letters Patent is hereby corrected as shown below:

Column 1, line 45, "distinguished Similarly" should read --distinguished. Similarly--.

Column 1, line 54, after "silent" add a period.

Column 2, line 15, "material Optionally" should read --material. Optionally--.

Column 2, line 30, "response The" should read --response. The--.

Column 3, line 32, "EA$" should read --EAS--.

Column 3, line 63, "embodiments" should read --embodiment--.

Column 6, line 7, "64, 6" should read --64, 66--.

UNITED STATES PATENT AND TRADEMARK OFFICE

CERTIFICATE OF CORRECTION

PATENT NO. : 4,967,185

DATED : October 30, 1990

INVENTOR(S) : SAMUEL MONTEAN

It is certified that error appears in the above-identified patent and that said Letters Patent is hereby corrected as shown below:

Column 10, line 15, "sheet the" should read --sheet, the--.

Column 10, line 20, "forming a flux" should read --forming flux--.

Column 10, line 21, "section and" should read --section, and--.

Column 10, line 22, "sheet piece of" should read --sheet of--.

Signed and Sealed this

Thirtieth Day of June, 1992

*Attest:*

DOUGLAS B. COMER

*Attesting Officer*

*Acting Commissioner of Patents and Trademarks*